United States Patent [19]

Rebel et al.

[11] Patent Number: 4,869,169

[45] Date of Patent: Sep. 26, 1989

[54] APPARATUS FOR CHAIN TRANSFER CONVEYANCE OF SHEET PRINTED IN A PRESS

[75] Inventors: Herbert Rebel, Rodgau; Marco Bergmann, Offenbach am Main, both of Fed. Rep. of Germany

[73] Assignee: M.A.N. - Roland, Fed. Rep. of Germany

[21] Appl. No.: 146,222

[22] Filed: Jan. 19, 1988

[30] Foreign Application Priority Data

Jan. 16, 1987 [DE] Fed. Rep. of Germany ..... 3701103

[51] Int. Cl.[4] ..... B41F 1/30

[52] U.S. Cl. ..... 101/408; 271/206

[58] Field of Search ..... 101/408; 271/204, 277, 271/205, 206, 277

[56] References Cited

U.S. PATENT DOCUMENTS

| | | | |
|---|---|---|---|
| 2,875,693 | 3/1959 | Jergrezl | 101/408 |
| 2,984,178 | 5/1961 | Koch | 271/206 |
| 2,997,157 | 8/1961 | Siebke | 271/204 |
| 3,186,709 | 6/1965 | Peyrebrune | 271/206 |
| 3,378,256 | 4/1968 | Ellis et al. | 271/204 |
| 3,591,169 | 7/1971 | Pruess | 271/206 |
| 3,929,069 | 12/1975 | Jahn | 101/408 |
| 4,413,562 | 11/1983 | Fischer | 101/408 |
| 4,524,964 | 6/1985 | Jamieson, Jr. | 101/408 |
| 4,596,184 | 6/1986 | Fischer | 101/408 |
| 4,693,362 | 9/1987 | Kemmerer | 101/408 |

*Primary Examiner*—Eugene H. Eickholt

*Attorney, Agent, or Firm*—Leydig, Voit & Mayer

[57] ABSTRACT

A sheet transfer conveyor for rotary sheet feed printing press comprising a pair of chains which support and transport a plurality of gripper carrying trolleys which successively engage the leading edge of a sheet from a printing press cylinder, such as an impression cylinder, for removing the sheet from the cylinder and transferring it to the next printing unit or to a delivery unit. The trolleys are supported on the chains by resilient mountings which, following engagement of a sheet by the gripper, pivot the trolley under a spring biasing force to maintain substantially constant tension on the sheet throughout the period the sheet is being removed from the cylinder. Guide rails are provided which define a guide channel for guiding the trolleys into predetermined relation to the cylinder for engaging the sheet, and at such point, the guide rails are recessed to permit pivotal movement of the trolley under the biasing force of the spring mounting.

12 Claims, 4 Drawing Sheets

APPARATUS FOR CHAIN TRANSFER CONVEYANCE OF SHEET PRINTED IN A PRESS

DESCRIPTION OF THE INVENTION

The present invention relates generally to sheet transfer conveyors for sheet-fed rotary printing presses, and more particularly, to chain conveyors which have a plurality of sheet gripper carrying trolleys adapted for successively engaging sheets from grippers on a cylinder, such as an impression cylinder of a printing press, and transferring the sheets away from the cylinder to the next printing unit or to a sheet delivery unit.

Chain type of sheet transfer conveyors are known in the art, as depicted, for example, in German Patent DE-PS No. 830 959. Conveyors of this type comprise a pair of endless chains that are trained around reversing and drive sprockets and carry plurality of trolleys, each having a sheet gripper comprising a support or pad and pivotably mounted gripping fingers adapted for engaging a sheet and securing it against the gripper support. The gripper supports typically project beyond the pitch circle diameter of the reversing sprockets around which the conveyor chains run near the place of transfer of the sheets from the impression cylinder of the press to the conveyor. During a sheet transfer operation, the gripper supports of the trolleys travel on a radius about its sprocket which is substantially equal to the radius of the gripper supports of the grippers on the impression cylinder. The supports of the grippers therefore move faster during the sheet transfer than the speed the chains travel around the the reversing sprockets. When the gripper trolley carrying portions of the chains disengage from the reversing sprockets and move substantially linearly away from the reversing sprockets, the speed of the grippers decreases to chain speed. However, the rear end of the sheet may not by this time have left the impression cylinder, and therefore is being advanced faster than the front end of the sheet being transferred by the chain conveyor. The sheet therefore ceases to be tensioned and waves may form in the sheet, with a high risk of set off. Also, the sheet will be retained on the blanket cylinder that cooperates with the impression cylinder until it is pulled away, the force of which sometimes can cause permanent deformation in the sheet. Finally, the length of the sheet being printed may vary during printing because of a wide variety of effects, such as flexing of the sheet in the printing zone and differences in stretch due to different humidity and ink conditions. Such stretching causes the tension that the grippers apply to the sheet to continually vary, which increases the likelihood of mackling of the sheet, particularly toward the trailing end thereof.

It is the object of the present invention to provide a chain type sheet transfer conveyor which is adapted to remove sheets from printing press cylinders with less likelihood of damage to the sheet or setoff.

Another object is to provide a chain type sheet conveyor as characterized above which is adapted to maintain sheets under substantially constant tension as they are removed from a cylinder of the printing press.

A further object is to provide a sheet transfer conveyor of the foregoing type which is relatively simply in construction and which lends itself economical manufacture and more reliable operation.

Other objects and advantages of the invention will become apparent upon reading the following detailed description and upon reference to the drawings, in which.

Figure 1:
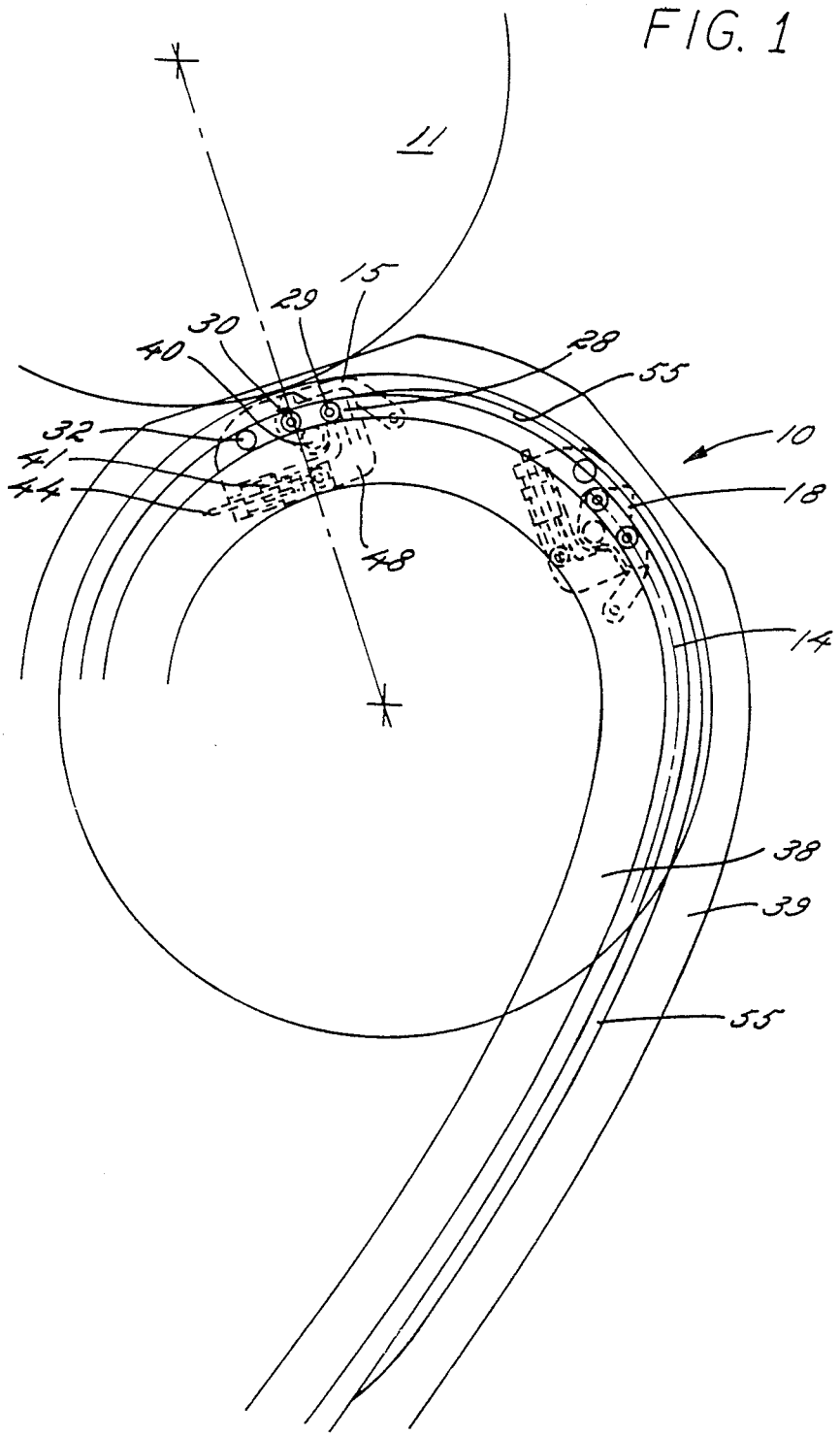
FIG. 1 is a partially diagrammatic, side elevational view of a sheet transfer conveyor system embodying the invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to FIG. 1, there is shown an illustrative sheet transfer conveyor 10 embodying the invention adapted for successively receiving sheets from a cylinder 11 of a printing press, such as an impression cylinder, and transferring the sheets to the next printing unit or to a sheet delivery unit. It will be understood that the impression cylinder 11 is provided with conventional sets of grippers (not shown) which are adapted to engage the leading edges of sheets directed onto the impression cylinder and which are synchronized to release the sheet in timed relation to operation of the sheet transfer conveyor 10.

Figure 3:
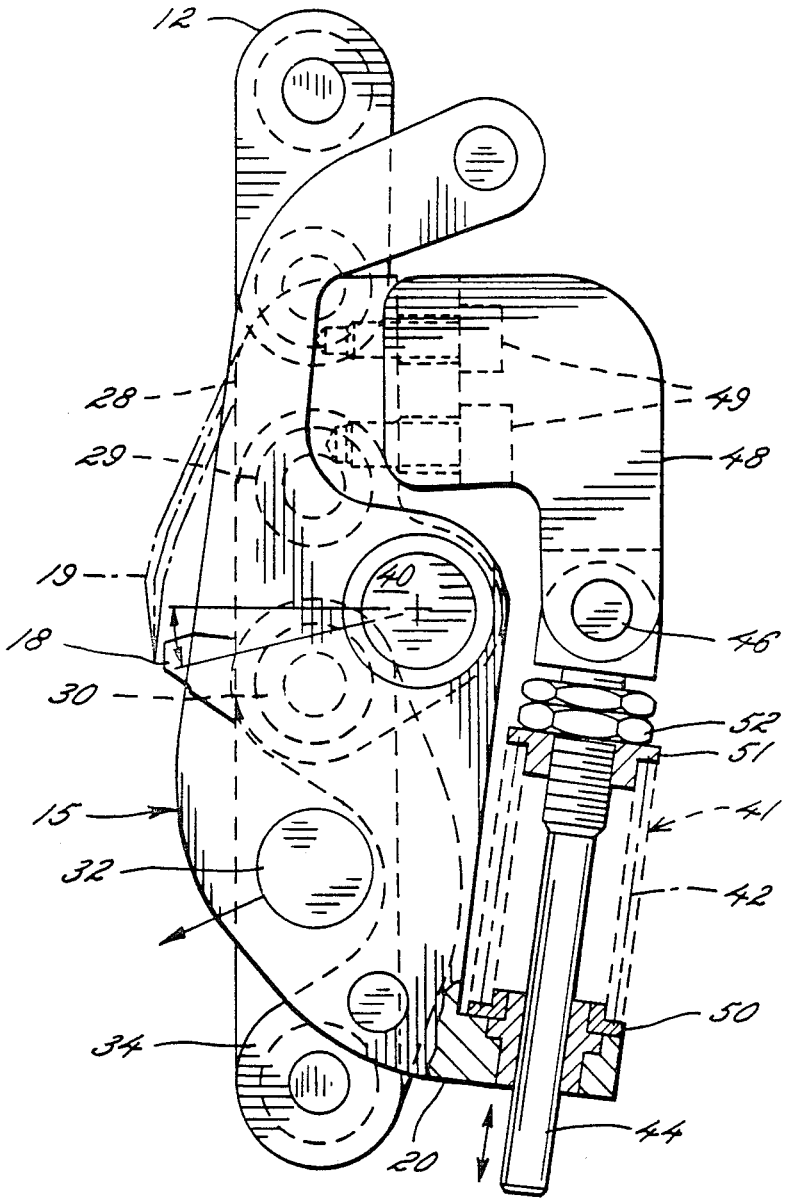
FIG. 3 is an enlarged section of one of the gripper carrying trolleys, taken in the plane of line 3—3 in FIG. 2.

The sheet transfer conveyor 10 includes a pair of chains 12 that are driven about sprockets in the conventional manner, including reversing sprockets 14 (diagrammatically shown in FIG. 1) disposed immediately adjacent the impression cylinder 11. The reversing sprockets 14 in this instance have a pitch circle radius which is slightly smaller than the diameter of the impression cylinder. The chains 12 support and transfer a plurality of trolleys 15, which each carry a sheet gripper comprising a sheet support or pad 18 and a gripping finger 19 (FIG. 3). The trolleys 15 in this instance each include a pair of axially spaced apart carriage members 20 that are connected by a pivotable shaft 21 which carries a pair of the gripper fingers 19 in axially spaced relation. The gripper support or pad 18 is mounted on a shaft 22 also supported between the carriage members 20. The gripper fingers 19 can be pivotably rocked in a conventional manner by rotation of the shaft 21 for engaging and releasing a sheet, such shaft rotation being effected by means of a control roller 24 supported on a crank arm 25 of the gripper shaft 21 (FIG. 3) which is engagable with an appropriate actuating cam in a known manner.

Figure 2:
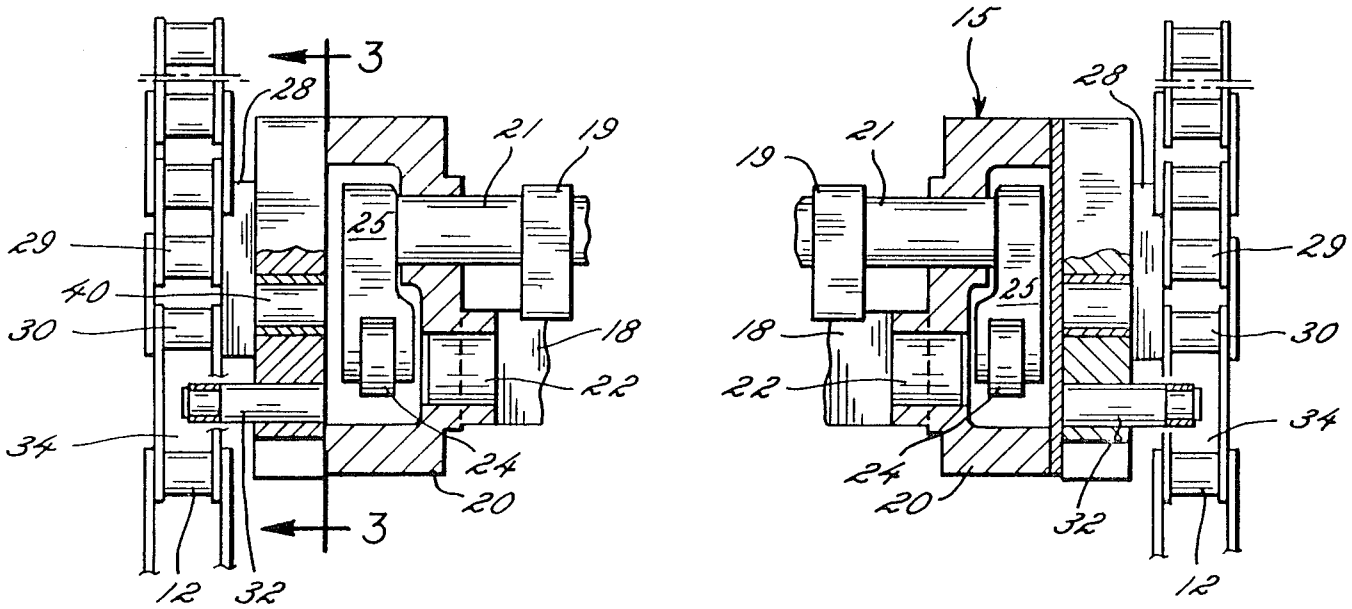
FIG. 2 is a vertical section of the chain conveyor of the illustrated sheet transfer conveyor system.

For securing the trolleys 15 to the chains 12, the carriage members each have a carrier plate 28 that is secured to pins 29, 30 of the chains 12 such that the trolleys 15 are drawn along with the chain movement. For guiding movement of the trolley 15 into position for sheet transfer as it approaches the impression cylinder 11, each carriage member 20 has an outwardly extending guide roller 32 that is directed between respective pairs of guide rails 38, 39. The; illustrated chain 12 has a banana-shaped link 34 which extends around the guide roller 32, as best shown in FIGS. 2 and 3.

Figure 4:
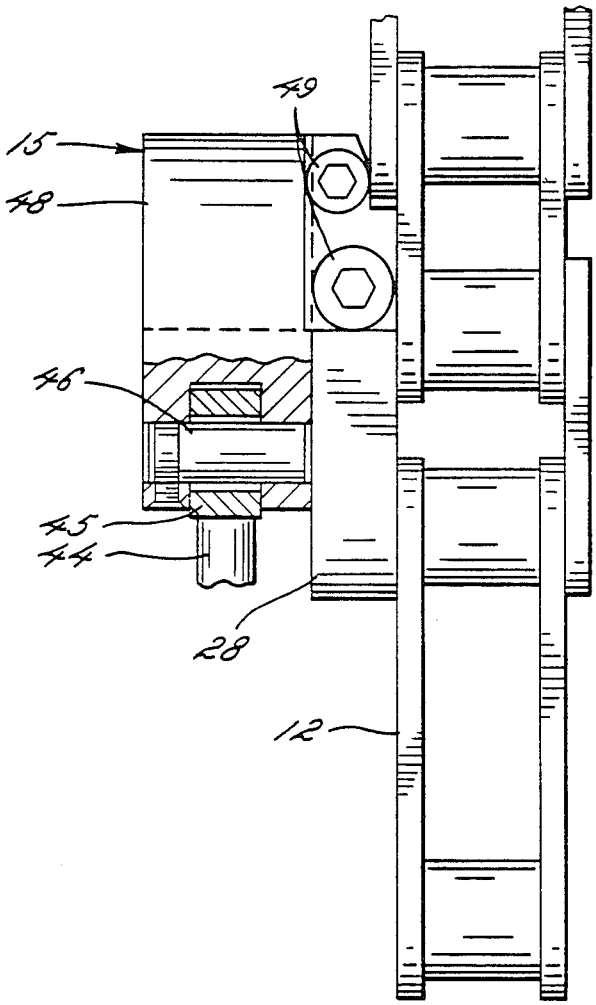
FIG. 4 is a side view showing the mounting of the trolley on the conveyor chain of the illustrated system.

In accordance with the invention, upon engaging of the leading edge of a sheet on the press cylinder, the sheet grippers of the trolleys are adapted to maintain a substantially constant tension on the sheets throughout the period the sheet is being removed from the press cylinder. To this end, the gripper carrying trolleys 15 are mounted for rotational movement relative to the side carrier plates 28, and the trolleys 15 are pivotable relative to the carrier plates 28 under the influence of resilient spring means following engagement with of a sheet for maintaining constant tension on the sheet. The carriage members 20 in this instance are pivotably supported relative to the carrier plate 28 on spindles 40 extending inwardly from the carrier plates 28, which preferably support the trolley 15 at its center of gravity. For biasing the trolleys 15 for pivotal movement about the spindles 40, a resilient mounting arrangement 41 is provided, as best shown in FIG. 3, which includes a spring 42 that is positioned over a guide rod 44. The guide rod 44 has a pivot bushing 45 at its upper end (FIG. 4) which is mounted for relative pivotal movement on a pin 46 carried on the depending leg of a right angle abutment 48, the opposite leg of which is fixed to the carrier plate 28 by screws 49. The lower end of the guide rod 44 extends through a bushing 50 affixed to the trolley carriage member 20 and is adapted for relative movement with respect thereto. The spring 41 is interposed between the bushing 50 and a bushing 51, the position of which is axially adjustable by a nut 52 so as to permit selective adjustment of the biasing force of the spring 41. It will be seen that by virtue of such resilient mounting arrangement 41 that the spring 41 biases the trolley 15 for pivotable movement about the spindles 40 in a clockwise direction as viewed in FIG. 3.

As the trolley 15 approaches the impression cylinder 11 for the purpose of receiving the leading edge of a sheet on the cylinder, the guide rollers 32 are guided into and retained between the guide rails 38, 39 so that the trolleys 15 are in properly oriented position for engaging a sheet. In order to enable the resilient mounting arrangement 41 to pivot the trolley 15 so as to maintain the sheet in a tensioned condition after it has been engaged by the grippers 18, 19 of the transfer conveyor 10 and is being withdrawn from the impression cylinder 11, the outer guide rails 39 each are formed with a recess 55 over the distance AA-BB, as shown in FIG. 1. The recesses 55 allows the guide rollers 32 for the trolleys to move outwardly as the trolleys are pivoted with respect to the side plates 28 under the influence of the resilient mounting arrangement 41, so as to maintain a constant tension on the sheet. During the length of the travel AA-BB, the outer guide rails 39 serve only to limit maximum pivoting of the trolley 15. Preferably during this portion of the travel the guide rollers 32 make no contact with the outer guide rails 39, so that the pull which the grippers 18, 19 exert on the sheet is determined by the adjustable tension of the springs 42, until such time as the sheet has been completely removed from the impression cylinder 11. Consequently, a resilient pulling force is imparted to the leading edge of the sheet beginning at the point AA of the recess 55 and such resilient pulling force continues to act on the leading edge of the sheet until it has left the printing zone.

From the foregoing, it can be seen that the chain type sheet transfer conveyor of the present invention is adapted to remove and transfer sheets from printing press cylinders with less likelihood of damage to the sheet and without set off. The sheets are maintained under constant tension throughout the sheet removal operation, notwithstanding differences in speed between the movement of the trolleys and the grippers on the printing press cylinder. The sheet transfer conveyor also is of relatively simple construction, and lends itself to economical manufacture and reliable operation.

We claim as our invention:

1. A sheet transfer conveyor for engaging successive sheets on the cylinder of a printing press and conveying the sheets away from the cylinder comprising a pair of chains, sprocket means for supporting and driving said chains including reversing sprockets disposed adjacent said cylinder, a plurality of trolleys carried by said chains, means supporting said trolleys on said chains, said trolleys each including a gripper comprising a gripper support and a gripper finger pivotably movable in timed relation to movement of said chains for engaging the leading edge of a sheet on said cylinder, and resilient means biasing each said trolley in pivotal relation to said mounting means upon said gripper engaging a sheet for maintaining the engaged sheet in tensioned condition throughout the period said sheet is being conveyed away from said cylinder.

2. The sheet transfer conveyor of claim 1 including means for guiding each trolley into predetermined relation to said cylinder prior to the gripper thereof engaging a sheet.

3. The sheet transfer conveyor of claim 2 in which said guide means include guide rails which define a guide channel, and said trolleys each include guide roller means that rides in said guide channel as said trolley is moved into position adjacent said cylinder prior to the gripper thereof engaging a sheet.

4. The sheet transfer conveyor of claim 1 in which said trolley supporting means for each trolley includes side carrier plates coupled to said chains, and spindle means supporting said trolley for pivotal movement relative to said side carrier plates.

5. The sheet transfer conveyor of claim 4 in which said spindle means supports said trolley at the center of gravity of said trolley.

6. The sheet transfer conveyor of claim 3 in which said guide rails guide said trolleys into predetermined relation to said cylinder during engagement of the sheet by the gripper of said trolley, and said guide rails are formed with a recess which permit pivotal movement of said trolley relative to said mounting means under the influence of said biasing means following sheet engagement by said gripper so that the gripper exerts a tension force on the sheet until it is completely removed from said cylinder.

7. The sheet transfer conveyor of claim 6 in which said mounting means includes an abutment fixed to said chain, and said biasing means includes a spring interposed between said abutment and said trolley.

8. The sheet transfer conveyor of claim 7 in which a rod extends from said abutment, and said spring is disposed on said rod.

9. The sheet transfer conveyor of claim 8 in which said rod is pivotably connected at one end to said abutment, and means supporting the other end of said rod for relative sliding movement with respect to said trolley.

10. The sheet transfer conveyor of claim 7 including means for selectively establishing the biasing force of said spring.

11. The sheet transfer conveyor of claim 10 in which said means for selectively establishing the biasing force of said spring includes an adjustable bolt disclosed at one end of said rod.

12. The sheet transfer conveyor of claim 3 in which said trolleys each carry a roller for engaging the guide channel by said guide rails, and said chains each include a banana shaped chain link disposed about one of said rollers.

* * * * *